US007249698B2

(12) United States Patent
Sutton et al.

(10) Patent No.: US 7,249,698 B2
(45) Date of Patent: Jul. 31, 2007

(54) GARMENT HANGERS WITH IMPROVED GRIPPING PADS AND IMPROVED METHODS OF MANUFACTURE

(75) Inventors: Steven Sutton, Brooklyn, NY (US); David P. Gordon, Stamford, CT (US)

(73) Assignee: The Accessory Corp.

( * ) Notice: Subject to any disclaimer, the term of this patent is extended or adjusted under 35 U.S.C. 154(b) by 180 days.

(21) Appl. No.: 11/042,232

(22) Filed: Jan. 25, 2005

(65) Prior Publication Data

US 2006/0163294 A1 Jul. 27, 2006

(51) Int. Cl.
*A41D 27/22* (2006.01)

(52) U.S. Cl. ..... 223/91; 223/93

(58) Field of Classification Search ..... 223/85–98
See application file for complete search history.

(56) References Cited

U.S. PATENT DOCUMENTS

| | | | | |
|---|---|---|---|---|
| 1,321,997 | A | 11/1919 | Duberstein | 223/85 |
| 2,920,801 | A | 1/1960 | Batts | 223/95 |
| 3,168,970 | A | 2/1965 | Willson | 223/85 |
| 3,358,891 | A | 12/1967 | Rowe | 223/85 |
| 3,767,092 | A | 10/1973 | Garrison et al. | 223/96 |
| 4,807,334 | A | 2/1989 | Blanchard | 223/96 |
| 5,018,650 | A | 5/1991 | Mauffette | 223/93 |
| 5,020,705 | A | 6/1991 | Garrison | 223/96 |
| 5,170,916 | A | 12/1992 | Kolton et al. | 223/92 |
| 5,183,191 | A | 2/1993 | Garrison et al. | 223/96 |
| 5,361,948 | A | 11/1994 | Batts | 223/96 |
| 5,398,854 | A | 3/1995 | Blanchard | 223/96 |
| 5,516,014 | A | 5/1996 | Garrison | 223/96 |
| 5,535,927 | A | 7/1996 | Garrison | 223/92 |
| 5,890,634 | A | 4/1999 | Zuckerman et al. | 223/96 |
| 6,047,868 | A | 4/2000 | Petrou et al. | 223/96 |
| 6,199,728 | B1 | 3/2001 | Cohen | 223/96 |
| 6,306,329 | B1 | 10/2001 | Willinger | 264/255 |
| 6,418,595 | B1 | 7/2002 | Shih | 24/536 |
| 6,612,000 | B2 | 9/2003 | Housley | 24/510 |
| 6,742,228 | B1 | 6/2004 | Kim | 24/507 |
| 6,745,924 | B2 | 6/2004 | Woodworth | 223/87 |
| D501,094 | S | 1/2005 | Hendricks | D6/326 |
| 6,871,765 | B2 | 3/2005 | Mainetti | 223/96 |
| 2004/0065702 | A1* | 4/2004 | Yang | 223/96 |

* cited by examiner

*Primary Examiner*—Shaun R. Hurley
(74) *Attorney, Agent, or Firm*—Gordon & Jacobson, P.C.

(57) ABSTRACT

A clamp style garment hanger includes a cross-bar, a hook extending up from the center of the cross-bar, a pair of clamp assemblies in spaced apart relationship depending from the cross-bar, and a pair of gripping pads, one for each clamp assembly. The clamp assemblies each include first and second clamping members coupled to and biased towards each other. According to one embodiment, a clamping member has a recess surrounding a throughbore. The gripping pad has a hollow extension and is dimensioned to fit snugly in the recess with its hollow extension extending into the throughbore. An interlocking plug is inserted through the rear of the throughbore into the hollow extension. According to another embodiment, the gripping pad has a stepped recess on one side and the clamping member has an integral interlocking plug that engages the recess.

21 Claims, 6 Drawing Sheets

GARMENT HANGERS WITH IMPROVED GRIPPING PADS AND IMPROVED METHODS OF MANUFACTURE

BACKGROUND OF THE INVENTION

1. Field of the Invention

This invention relates broadly to clamp-type garment hangers with clamp assemblies that include non-slip surfaces for positively gripping garments, and more particularly to clamp-type garment hangers wherein the exposed surface of the garment gripping pad is made of resilient friction material for positively gripping the garments.

2. State of the Art

U.S. Pat. No. 5,890,634, issued Apr. 6, 1999 to Zuckerman et al., describes disadvantages of clamp-type garment hangers which do not have gripping pads in the clamps and proposes a solution. The Zuckerman solution provides a clamp-type garment hanger including a hook, a cross-bar and two garment clamp assemblies. The hook extends upwardly from the cross-bar for suspending the garment hanger from a support location. The clamp assemblies are located on opposite ends of the cross-bar for securing a garment to the garment hanger. Each clamp assembly includes a first clamping member, a second clamping member, and means for biasing the first and second clamping members toward one another and into abutting engagement with a garment located between the clamping members. Each clamp assembly includes at least one clamping member having an inner clamping surface defined at least in part by at least one gripping pad. A first side of the gripping pad is carried by the inner clamping surface of the clamping member, and a second side of the gripping pad is presented for contact with a garment to be hung from the garment hanger. Snap-in securing means secure the gripping pad on the clamping member for movement as a unit into and from the clamping position. Preferably, the gripping pad is fabricated from resilient friction material, the coefficient of friction being sufficiently high to preclude movement under the weight of the garment when a normal clamping force is applied to the two clamping members to move them into a clamping position. However, in order to maintain the gripping pad snapped-in to the clamping member, it must be made of sufficiently hard material which does not provide the most desirable coefficient of friction. Although the Zuckerman patent hints that the snap-in side and the frictional side of the gripping pad might be made of different materials, there is no explicit teaching of how this could be done. Moreover, it is clear that to do so would be more complicated and more expensive than making the gripping pads of a single material.

SUMMARY OF THE INVENTION

It is therefore an object of the invention to provide a clamp style garment hanger.

It is another object of the invention to provide improved gripping pads for a clamp style garment hanger.

It is a further object of the invention to provide an improved method of assembling gripping pads in a clamp style garment hanger.

In accord with these objects, which will be discussed in detail below, a clamp style garment hanger according to the invention includes a cross-bar, a hook extending up from the center of the cross-bar, a pair of clamp assemblies in spaced apart relationship depending from the cross-bar, and a pair of gripping pads, one for each clamp assembly. The clamp assemblies each include a first clamping member and a second clamping member hingedly coupled to it and biased towards it. A gripping pad is coupled to one or both of the clamping members facing the other clamping member. According to the invention, the gripping pad is made of a soft resilient material which presents a high coefficient of friction to the garment. According to one embodiment, the clamping member to which the gripping pad is coupled has a recess surrounding a throughbore. The gripping pad has a hollow extension and is dimensioned to fit snugly in the recess of the clamping member with its hollow extension extending into the throughbore or the clamping member. An interlocking plug is inserted through the rear of the throughbore and into the hollow extension of the gripping pad. This secures the gripping pad to the clamping member and maintains it in position without compromising the frictional coefficient of the gripping pad.

According to a second embodiment, a gripping pad is coupled to each clamping member in the manner described above. According to a third embodiment, the gripping pad has one or more stepped recesses on one side and the clamping member to which it is attached has a corresponding number of integral interlocking plugs which engage the recesses. A fourth embodiment is the same as the third embodiment but with a gripping pad coupled to each clamping member.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
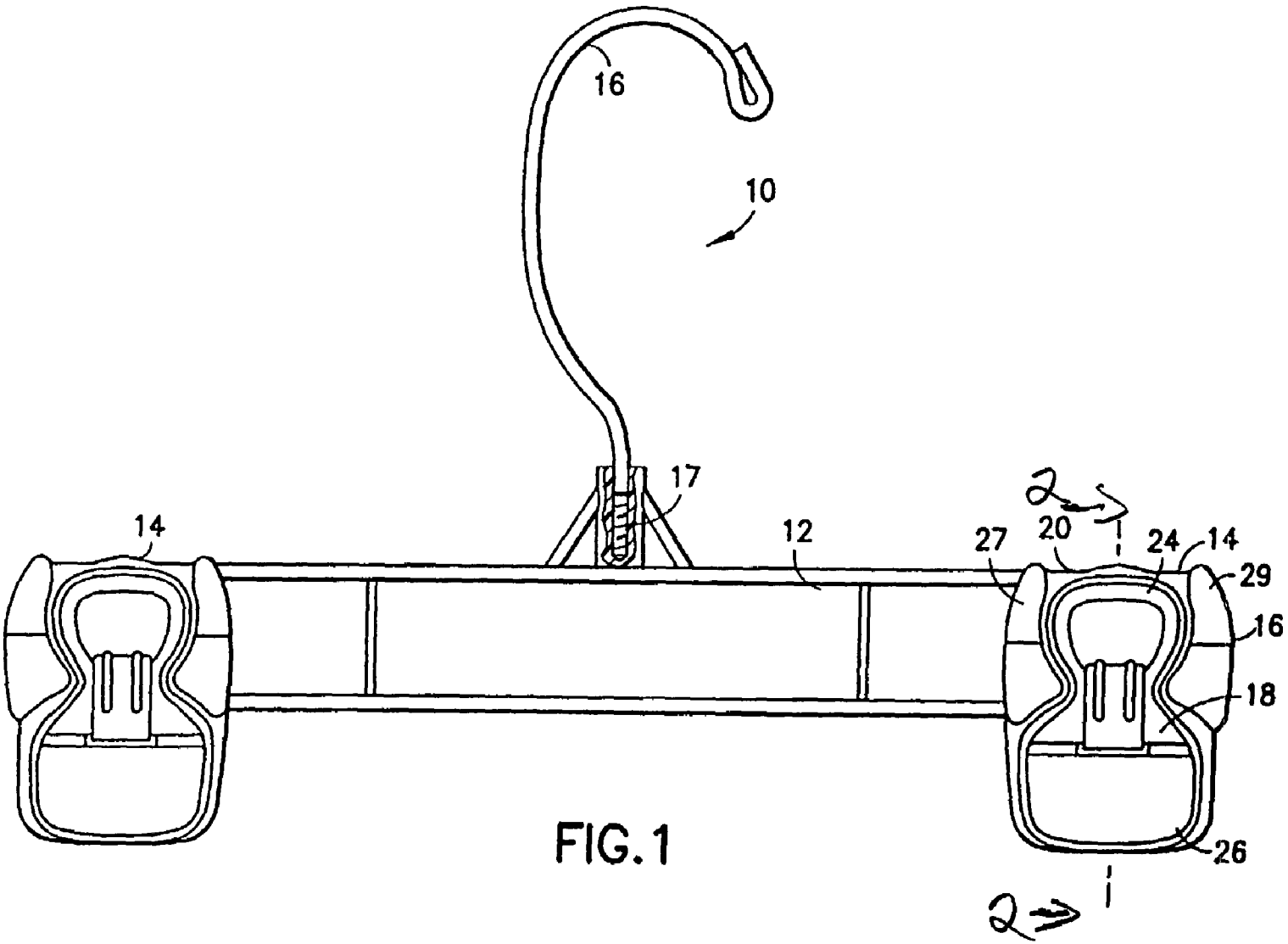
FIG. 1 is a front elevation view of a clamp-type garment hanger according to the invention.

Turning now to FIG. 1, a garment hanger 10 includes a cross-bar 12 having at each end a clamping assembly 14. A partial loop or hook member 16, which may be formed from plastic or metal wire or any other appropriate material, extends upward from the center of the cross-bar 12. The partial loop or hook member may be secured via threads 17 to the cross-bar 12, as shown, or may be integrally formed from the same material as the cross-bar 12, or may be connected to the cross-bar in any other manner. The cross-bar 12 is preferably made from any number of well known plastic or resin materials, such as "k"-resin, polystyrene, polypropylene, polyethylene, styrene-butadiene copolymers and blends, polycarbonates, and combinations thereof.

Figure 2:
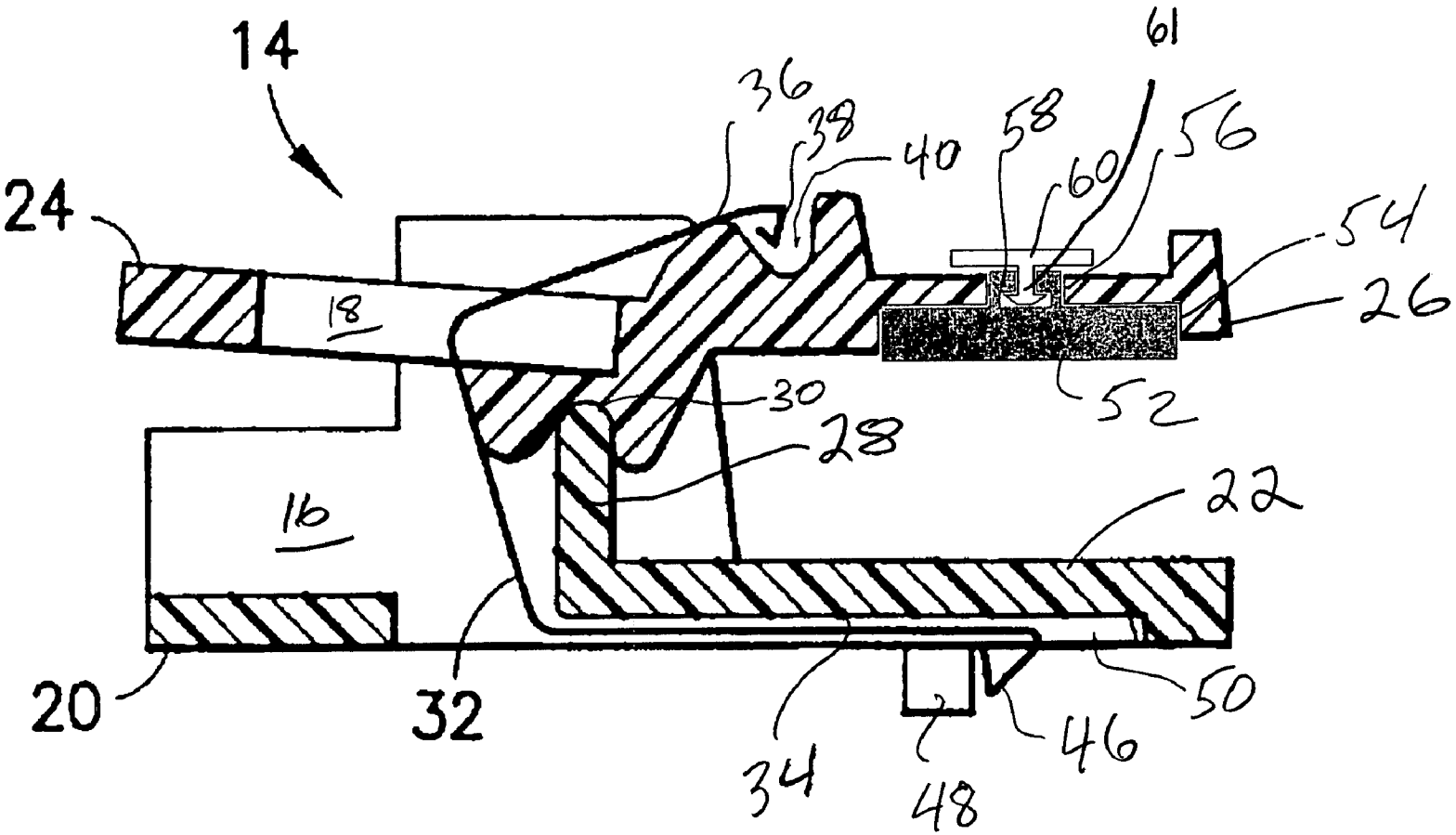
FIG. 2 is a sectional view taken along the line 2-2 of a first embodiment of a clamp assembly with the clamping members in a partially open position.

Referring now to FIGS. 1 and 2, the clamping assemblies 14 are preferably formed from the same material as the cross-bar 12. Each clamping assembly 14 has a back base clamping member 16 which is preferably integrally formed with the cross-bar, and a front lever clamping member 18 movable relative thereto. The base member 16 includes a handle portion 20 and a jaw end 22, and the lever member 18 includes a handle portion 24 which is opposite handle portion 20, and a jaw end 26 which is positioned opposite jaw end 22. The lever member 18 is pivotally supported on the base member 16 along a pivot wall 28 extending between two supports 27, 29 on the base member 16. The pivot wall 28 is received in a pivot groove 30 on the back of lever member 18. A C-shaped spring clip 32, preferably made of metal or another material having appropriate spring tension, is dimensioned to receive a portion of the base member 16 and a portion of the lever member 18 and is positioned over those portions such that facing inner surfaces of the spring clip 32 bear against outwardly facing surfaces 34, 36 of the base member 16 and the lever member 18, respectively. A front end of the spring clip 32 has a flange 38 that engages within an aperture 40 in the lever member 18 to secure the spring clip 32 to the lever member. A rear end of the spring clip 32 has a tab 46 which engages a strut 48 spanning an aperture 50 in the base member 16 to secure the spring clip to the base member. Optionally, the strut may be omitted. The spring clip 32 urges the lever member jaw end 26 towards the base member jaw end 22.

According to a first embodiment of the invention, as illustrated in FIG. 2, a gripping pad 52 is coupled to one of the clamping members 18 facing the other clamping member 16. The gripping pad 52 is made of a soft resilient material which presents a high coefficient of friction to the garment. Suitable materials include thermoplastic elastomer (TPE), thermoplastic rubber (TPR), thermoplastic urethane (TPU), styrene butadiene copolymer (SBC), etc. The clamping member 18 to which the gripping pad 52 is coupled has a recess 54 surrounding a throughbore 56. The gripping pad 52 has a hollow extension 58 and is dimensioned to fit snugly in the recess of the clamping member with its hollow extension extending into the throughbore of the clamping member. An interlocking plug 60 is inserted through the rear of the throughbore 56 and into the hollow extension 58 of the gripping pad 52. The plug 60 is preferably made of a material of similar hardness to the hardness of the gripping pad to facilitate its insertion and engagement. This secures the gripping pad about the clamping member and maintains it in position without requiring that the gripping pad to be made of a hard material as in the prior art.

Figure 3:
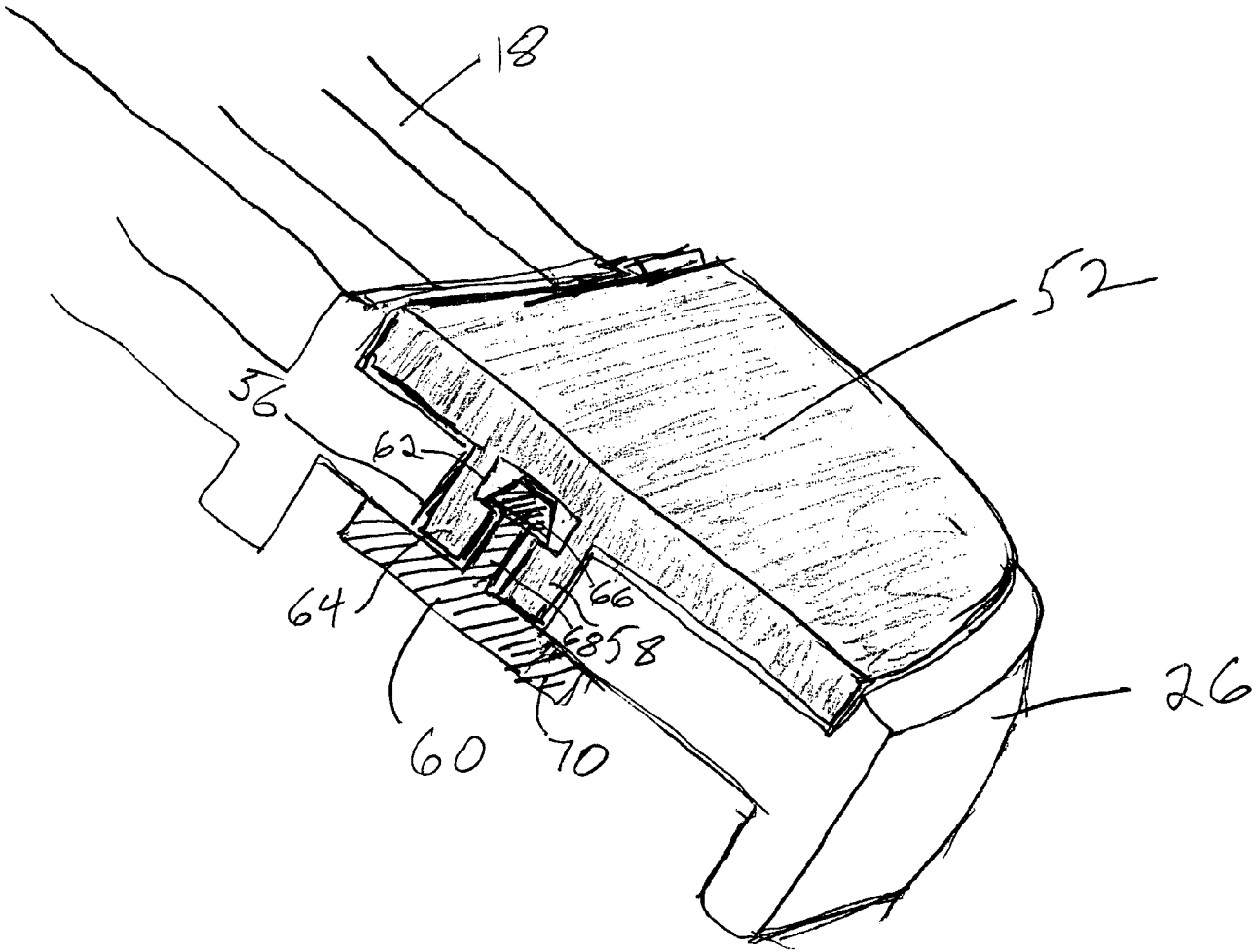
FIG. 3 is a broken perspective sectional view of a portion of a clamping member illustrating the attachment of the gripping pad.

As illustrated, and seen best in FIG. 3, the hollow extension 58 of the gripping pad 52 has an inner large diameter portion 62 and an outer small diameter portion 64, thereby exhibiting a substantially T-shaped cross section or stepped interior. The interlocking plug has a substantially conical or frustroconical tip 66 with a base diameter greater than the small diameter portion 64 of the hollow extension 58, a stem 68 which has a diameter preferably no larger than the small diameter portion 64 of the hollow extension 58, and a base 70 having a diameter larger than the diameter of the throughbore 56 of the gripping member 18.

If desired, the recess 54 in the clamping member 18 may be provided with multiple recesses, and the gripping pad 52 may be provided with multiple extensions 58 into which multiple plugs 60 may be inserted. Also, if desired, when a pad with multiple extensions 58 is utilized, instead of utilizing multiple plug element, a single plug element with multiple stems 68 and tips 66 may be provided, so that a single piece is used to make multiple mating connections.

Figure 4:
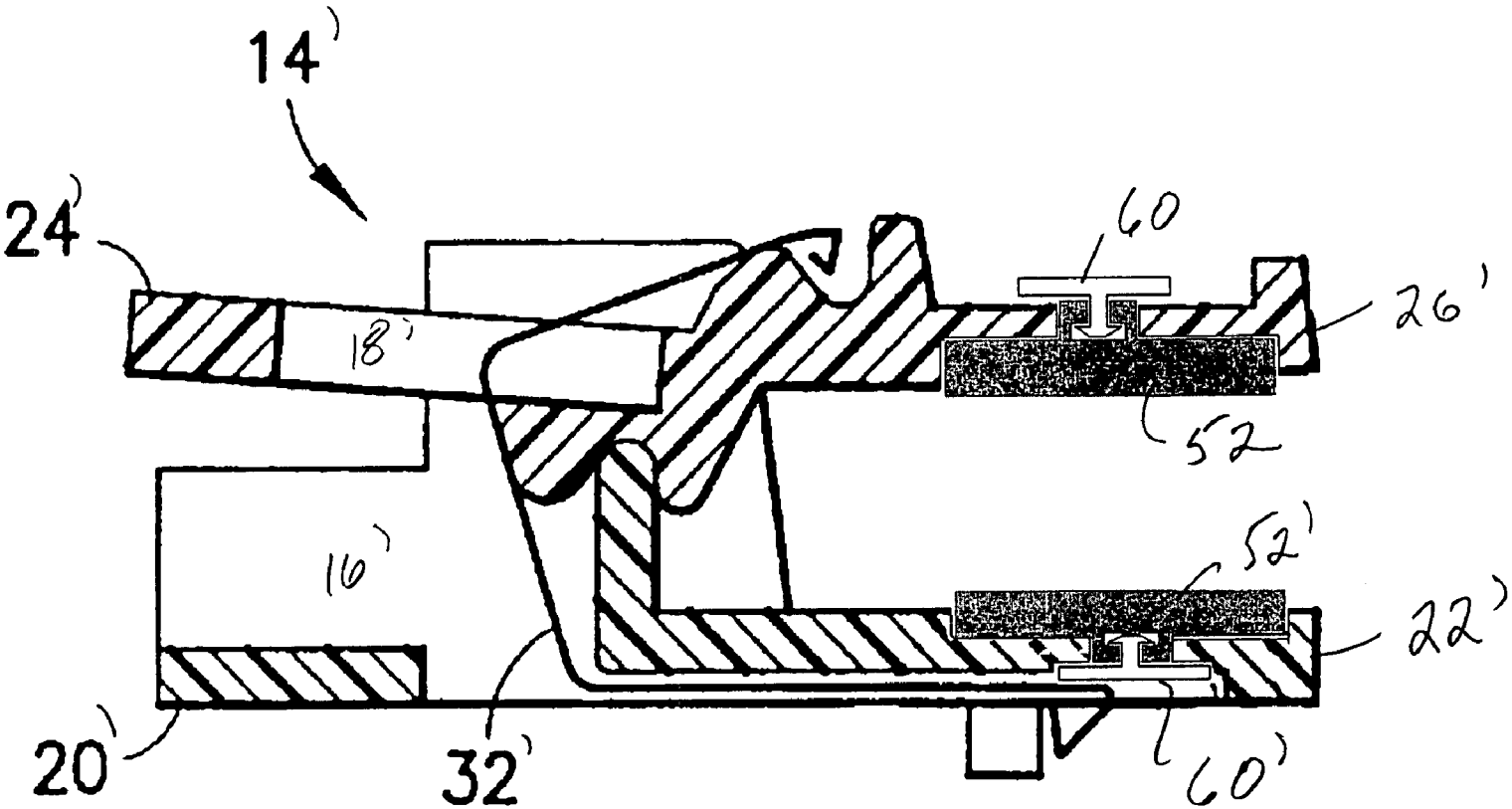
FIG. 4 is a view similar to FIG. 2 illustrating a second embodiment having gripping pads attached to both clamping members.

FIG. 4 illustrates a second embodiment of a clamping assembly 14' which is similar to the assembly 14 with similar reference numerals (having a "prime" notation) referring to similar parts. In this embodiment, both clamping members 16' and 18' are provided with gripping pads 52, 52' which are substantially the same and which are assembled in substantially the same way with an interlocking plug 60, 60'.

From the foregoing, it will be appreciated that a method for manufacturing a hanger according to the invention includes the steps of forming the clamping members with recesses and throughbores, forming the gripping pads with hollow extensions, and forming the interlocking plugs. The assembly process includes placing the gripping pads in the recesses with the hollow extensions extending into the throughbores, and inserting the interlocking plugs into the hollow extensions. After these steps have been performed, the pairs of clamping members can be assembled with the spring clips.

Figure 5:
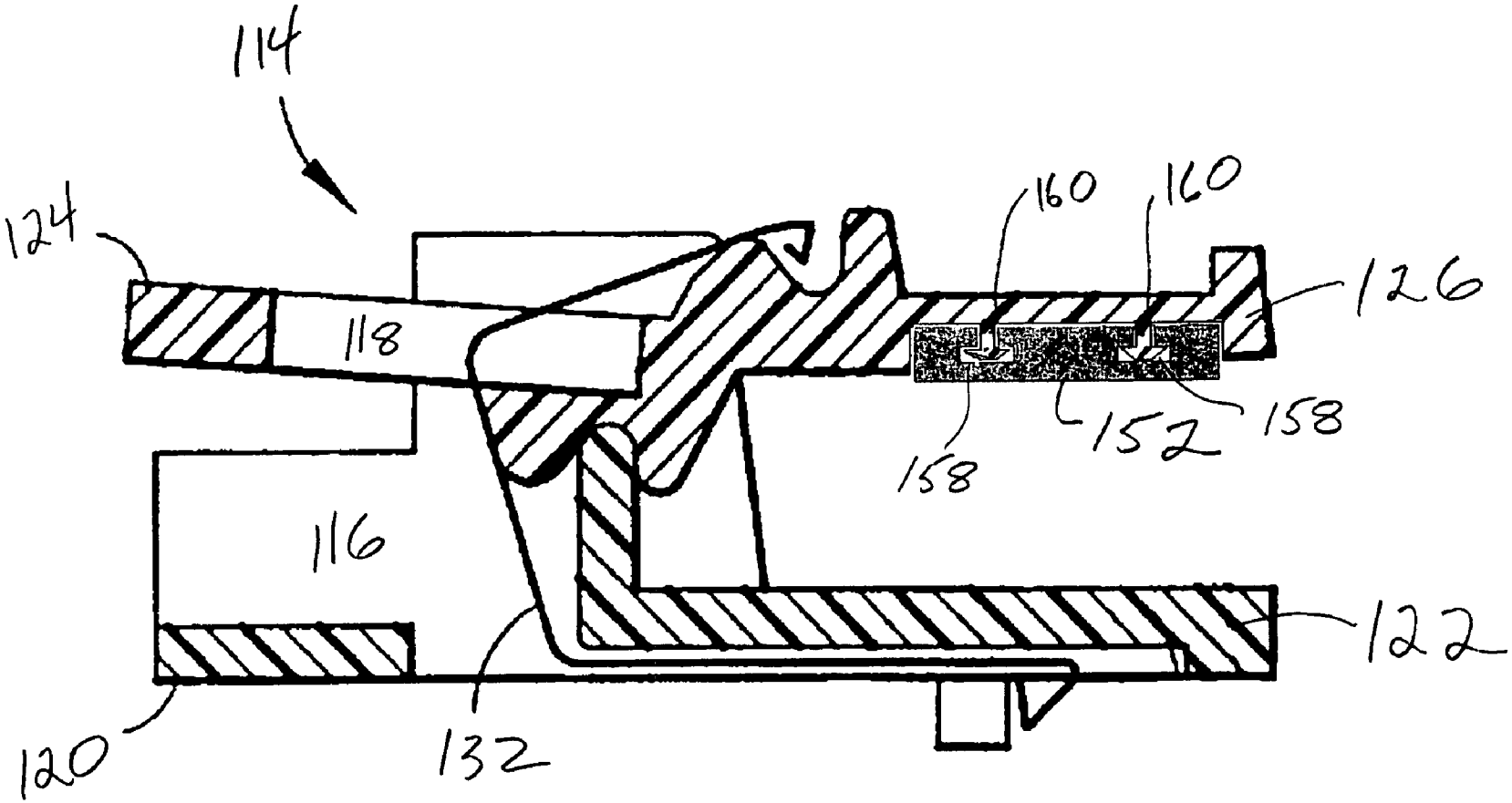
FIG. 5 is a view similar to FIG. 2 illustrating a third embodiment wherein interlocking plugs are integral with a clamping member.

FIG. 5 illustrates a third embodiment of the invention with similar reference numerals (increases by 100 as compared to the first embodiment) referring to similar parts. According to this embodiment, the gripping pad 152 has one or more stepped recesses 158 on one side thereof and the clamping member 118 has a corresponding number of integral interlocking plugs 160 which engage the stepped recesses and secure the gripping pad to the clamping member.

From the foregoing, it will be appreciated that a method for manufacturing a hanger according to the third embodiment invention includes the steps of forming the clamping members with integral interlocking plugs, forming the gripping pads with stepped recesses. The assembly process includes placing the gripping pads over the plugs and aligning the recesses with the plugs, then pressing the gripping pads onto the plugs until the plugs enter and engage the recesses. After these steps have been performed, the pairs of clamping members can be assembled with the spring clips.

Figure 6:
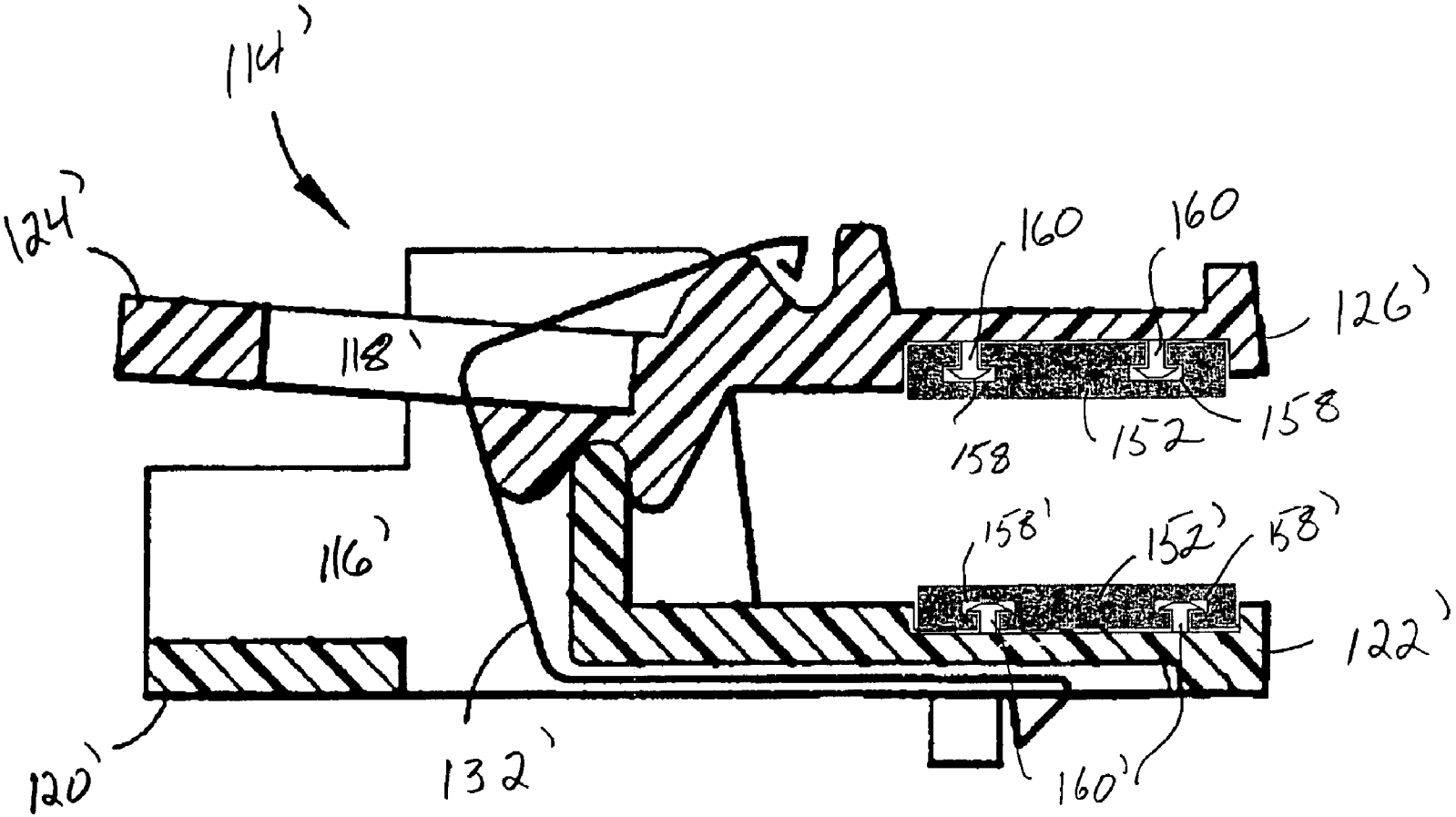
FIG. 6 is a view similar to FIG. 5 illustrating a fourth embodiment having gripping pads attached to both clamping members.

FIG. 6 illustrates a fourth embodiment of a clamping assembly 114' which is similar to the assembly 114 with similar reference numerals (having a "prime" notation) referring to similar parts. In this embodiment, both clamping members 116' and 118' are provided with gripping pads 152, 152' which are substantially the same and which are assembled in substantially the same way as the third embodiment.

There have been described and illustrated herein several embodiments of a clamp-type garment hanger and methods of attaching gripping pads to clamping members. While particular embodiments of the invention have been described, it is not intended that the invention be limited thereto, as it is intended that the invention be as broad in scope as the art will allow and that the specification be read likewise. For example, while the clamps have been shown as integral with the cross bar, clamps according to the invention could be incorporated in a sliding type hanger where the clamps are movable relative to each other to accommodate different size garments. Also, while the clamping members have been illustrated with one member stationary and the other movable, it is possible to configure the clamping members so that both are movable. It will therefore be appreciated by those skilled in the art that yet other modifications could be made to the provided invention without deviating from its spirit and scope as claimed.

What is claimed is:

1. A garment hanger, comprising:

a) a cross-bar;

b) a hook extending up from said cross-bar;

c) a pair of clamp assemblies spaced apart from each other and depending from said cross-bar, each clamp assembly including i) a first clamping member, ii) a second clamping member, movable relative to said first clamping member, iii) a first gripping pad coupled to one of said clamping members, said one of said clamping members having a recess surrounding a throughbore, said first gripping pad having a hollow extension and being dimensioned to fit in said recess with said hollow extension extending into said throughbore, and iv) a first interlocking plug extending into said hollow extension and securing said first gripping pad to said one of said clamping members, wherein said first interlocking plug has a substantially conical or frustroconical tip, a stem extending from said tip, and a base coupled to said stem, said base having a dimension larger than the diameter of said throughbore.

2. The hanger according to claim 1, wherein:

said first gripping pad has a hardness substantially different than a hardness of said first and second clamping members.

3. The hanger according to claim 1, wherein:

said first clamping member is rigidly coupled to said cross-bar.

4. The hanger according to claim 3, wherein:

said one of said clamping members is said second clamping member.

5. The hanger according to claim 4, wherein:

each clamp assembly further includes v) a second gripping pad coupled to said first clamping member, said first clamping member having a recess surrounding a throughbore, said second gripping pad having a hollow extension and being dimensioned to fit in said first clamping member recess with said hollow extension extending into said first clamping member throughbore, and vi) a second interlocking plug extending into said hollow extension of said second gripping pad and securing said second gripping pad to said first clamping member.

6. The hanger according to claim 5, wherein:

said second gripping pad has a hardness substantially different than a hardness of said first and second clamping members.

7. The hanger according to claim 1, wherein:

said hollow extension has inner larger diameter portion and an outer smaller diameter portion, and said substantially conical or frustroconical tip has a tip base at a junction of said tip and said stem, said tip base having a dimension larger than said outer diameter portion of said hollow extension.

8. The hanger according to claim 5, wherein:

each of said interlocking plugs has a substantially conical or frustroconical tip, a stem extending from said tip, and a base coupled to said stem, said base having a dimension larger than the diameter of said throughbores.

9. A garment hanger, comprising:

a) a cross-bar;

b) a hook extending up from said cross-bar;

c) a pair of clamp assemblies spaced apart from each other and depending from said cross-bar, each clamp assembly including i) a first clamping member, ii) a second clamping member, movable relative to said first clamping member, iii) a first gripping pad having a stepped recess on one side thereof, one of said clamping members having an integral interlocking plug extending into said stepped recess and securing said first gripping pad to said one of said clamping members.

10. The hanger according to claim 9, wherein:

said first gripping pad has a hardness substantially different than a hardness of said first and second clamping members.

11. The hanger according to claim 9, wherein:

said first clamping member is rigidly coupled to said cross-bar.

12. The hanger according to claim 11, wherein:

said one of said clamping members is said second clamping member.

13. The hanger according to claim 12, wherein:

each clamp assembly further includes iv) a second gripping pad having a stepped recess on one side thereof, said first clamping member having a an integral interlocking plug extending into said stepped recess of said second gripping pad and securing said second gripping pad to said first clamping member.

14. The hanger according to claim 13, wherein:

said second gripping pad has a hardness substantially different than a hardness of said first and second clamping members.

15. The hanger according to claim 9, wherein:

said integral interlocking plug has a substantially conical or frustroconical tip and a stem extending from said tip.

16. The hanger according to claim 13, wherein:

each of said integral interlocking plugs has a substantially conical or frustroconical tip and a stem extending from said tip.

17. A method of securing a gripping pad to a clamping member of a clamping assembly of a garment hanger, said method comprising:

a) forming the gripping pad with a stepped recess on one side thereof;

b) engaging the stepped recess with an interlocking plug such that the plug secures the gripping pad to or about the clamping member.

18. The method according to claim 17, farther comprising:

c) forming the clamping member with a throughbore; and d) forming the interlocking plug with a base having a larger diameter than the throughbore, wherein said step of engaging includes inserting the plug through one side of the throughbore into the stepped recess on the other side of the throughbore.

19. The method according to claim 18, farther comprising:

e) forming the clamping member with a recess surrounding the throughbore, wherein said step of engaging includes placing the gripping pad in the recess of the clamping member with the stepped recess of the gripping member facing the throughbore.

20. The method according to claim 18, further comprising:

f) forming the stepped recess of the gripping pad as a hollow extension extending from the one side of the gripping pad, wherein said step of engaging includes inserting the hollow extension into the throughbore.

21. The method according to claim 17, further comprising:

c) forming the clamping member with an integral interlocking plug, wherein said step of engaging the stepped recess with an interlocking plug includes engaging the stepped recess with the integral interlocking plug of the clamping member.

* * * * *